US005623791A

United States Patent [19]

Schwarz

[11] Patent Number: 5,623,791

[45] Date of Patent: Apr. 29, 1997

[54] PROTECTIVE GRILLE ASSEMBLY AND METHOD OF MOUNTING THEREOF

[76] Inventor: Chanan Schwarz, 30 Raanan Street, 34385 Haifa, Israel

[21] Appl. No.: 330,842

[22] Filed: Oct. 27, 1994

Related U.S. Application Data

[63] Continuation-in-part of Ser. No. 66,256, May 25, 1993, abandoned.

[30] Foreign Application Priority Data

May 26, 1992 [IL] Israel ..... 102009

[51] Int. Cl.[6] ..... E06B 3/68

[52] U.S. Cl. ..... 52/107; 52/507; 52/202; 49/50; 49/57; 256/24; 256/68; 248/74.1

[58] Field of Search ..... 52/507, 202, 106, 52/107; 49/50, 55, 56, 57; 256/24, 68, 25; 248/68.1, 74.1, 300; 160/104, 371

[56] References Cited

U.S. PATENT DOCUMENTS

| | | | |
|---|---|---|---|
| 377,624 | 2/1888 | Kuenzel | 49/57 |
| 1,148,012 | 7/1915 | Elliott | 49/57 X |
| 2,589,878 | 3/1952 | Shapiro | 49/55 X |
| 2,668,729 | 2/1954 | Watters | 49/50 X |
| 3,711,050 | 1/1973 | Case | 248/300 X |
| 4,148,277 | 4/1979 | Engle et al. | 256/24 X |
| 4,358,910 | 11/1982 | Keating et al. | 49/56 |
| 4,400,912 | 8/1983 | Wicks, Sr. | 49/56 X |
| 4,993,670 | 2/1991 | Tesar | 248/74.1 X |
| 5,014,940 | 5/1991 | Sherman | 248/74.1 |

*Primary Examiner*—Carl D. Friedman
*Assistant Examiner*—Winnie Yip
*Attorney, Agent, or Firm*—Benjamin J. Barish

[57] ABSTRACT

A protective grille assembly mountable over a window opening in a wall, includes a grill panel having a plurality of parallel, spaced, vertical bars fixed to a plurality of parallel, spaced, horizontal bars. The grille panel is of larger dimensions than the window opening such that the ends of the bars along at least one side project past the respective side of the window opening when the grille panel is mounted thereto. A plurality of fastening brackets mount the grille panel to the wall to cover the opening. Each bracket includes a loop section for slidably enclosing an end of a bar at the projecting side of the grille panel, and a fastening section for fastening the bracket to the wall after the loop section, while enclosing an end of a bar, has been slid along the respective bar to a location where the fastening section can be fastened to a mounting surface of the wall.

6 Claims, 6 Drawing Sheets

PROTECTIVE GRILLE ASSEMBLY AND METHOD OF MOUNTING THEREOF

RELATED APPLICATION

The present application is for a continuation-in-part of U.S. patent application Ser. No. 08/066,256, filed May 25, 1993, now abandoned.

FIELD AND BACKGROUND OF THE INVENTION

The present invention relates to a protective grille or lattice assembly mountable over a window opening in a wall, and also to a method of mounting such a protective grille or lattice assembly.

Protective grilles or lattices are frequently mounted over window openings for purposes of preventing exit from the opening (e.g., a child from falling out of a window), or of preventing entry through the opening (e.g., thieves from entering a building). Protective grilles are generally tailor-made to the size of the window opening to which the grille is to be mounted, which substantially increases their cost of manufacture. Moreover, the present tailor-made protective grilles are generally mounted to the window openings by skilled workmen, which substantially increases their cost of installation.

OBJECTS AND BRIEF SUMMARY OF THE INVENTION

An object of the invention is to provide a protective grille assembly which can be manufactured and installed at substantially lower cost than the existing protective grille assemblies. Another object of the invention is to provide a method of mounting such protective grille assemblies.

According to the present invention, there is provided a protective grille assembly mountable over a window opening in a wall, including a grill panel having a plurality of parallel, spaced, vertical bars fixed to a plurality of parallel, spaced, horizontal bars, the grille panel being of larger dimension than the window opening side, such that the ends of the bars along at least one side project past the respective side of the window opening when the grille panel is mounted thereto; and a plurality of brackets for mounting the grille panel to the wall to cover the window opening. Each of the brackets includes a loop section for slidably enclosing an end of a bar at the projecting side of the grille panel, and a fastening section for fastening the bracket to the wall after the loop section, while enclosing an end of a bar, has been slid along the respective bar to a location where the fastening section can be fastened to a mounting surface of the wall.

A protective grille assembly constructed in accordance with the foregoing features may be mass-produced at low cost in a limited number of sizes and sold directly to the customer off the shelf. All the customer needs to know are the approximate dimensions of the window opening to which the protective grille assembly is to be applied; the exact dimensions of the protective grille assembly are unimportant as long as they are greater than those of the window opening. The customer may mount the protective grille assembly over the window opening by first applying the loop sections of a plurality of the brackets to the ends of a plurality of bars at the projecting side of the grille panel, then sliding the brackets along the bars until the fastening sections of the brackets contact the wall mounting surface, and finally fastening the brackets to the wall mounting surface by mounting bolts. It will thus be seen that the protective grille assembly may be easily mounted using conventional tools commonly found in the home.

The description below illustrates a number of different types of fastening brackets which may be used in the protective grille assembly. Depending on the type of brackets used, the protective grille assembly may be mounted substantially flush with the window opening (i.e., with the inner surface of the grille panel substantially flush with the outer surface of the mounting wall), or the grille panel may be mounted to project outwardly of the window opening. The bars of the grille panel can be of any standard material and dimensions depending on the particular application. For example, if the grille panel is intended for child safety purposes, relatively light-weight bars may be sufficient; whereas if the grille panel is intended to prevent forced entry, heavier bars would normally be used.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
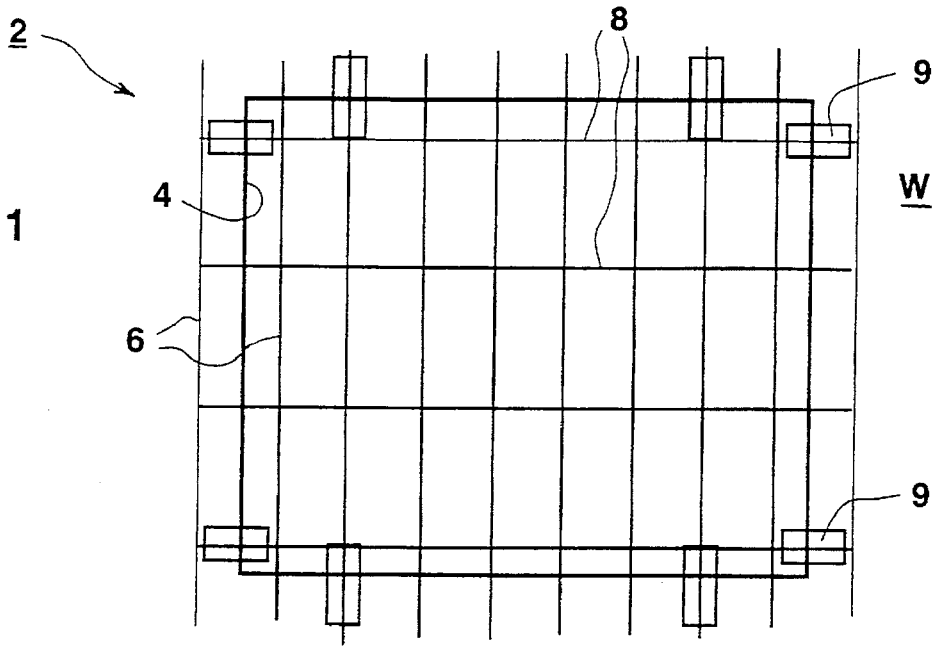
FIG. 1 schematically illustrates one form of protective grille assembly mounted over a window opening in accordance with the present invention.

With reference to FIG. 1, there is illustrated a lattice or grille panel, generally designated 2, mounted to a wall over a window opening 4. The grille panel 2 includes a plurality of parallel, spaced, vertical bars 6 fixed to a plurality of parallel, spaced, horizontal bars 8 in any suitable manner, as by spot-welding. The diameter and material of the bars, as well as the spacings between them, depend on the particular application. Although the illustrated grille panel does not include a frame enclosing the bars, such a frame may be provided if desired.

The grille panel 2 is of larger dimensions than the window 4 so that the grille panel, when being mounted, projects outwardly past the window along at least one side. In the schematic illustration of FIG. 1, the grille panel 2 projects past the window 4 on all four sides, so that all four sides of the grille panel may be used for mounting the grille panel to the wall in the manner to be described below and by using fastening brackets schematically illustrated in FIG. 1 by the reference numeral 9.

Briefly, each of the fastening brackets (9, FIG. 1) includes a loop section for slidably enclosing an end of a bar (6, 8) at the projecting side of the grille panel 2, and a fastening section for fastening the bracket to the wall W. A plurality of the fastening brackets 9 are first applied by enclosing their loop sections around one of the bars (6, 8) at the respective projecting side of the grille panel. The brackets are then slid along their respective bars until their fastening sections contact a mounting surface of the wall, whereupon the fastening sections of the brackets are fixed to the mounting surface of the wall. Thus, the grille panel does not have to be dimensioned to precisely fit the window opening so long as it is slightly larger than the window opening. In addition, the actual mounting of the grille panel may be done in a "do it yourself" manner, using conventional tools.

Figure 2:
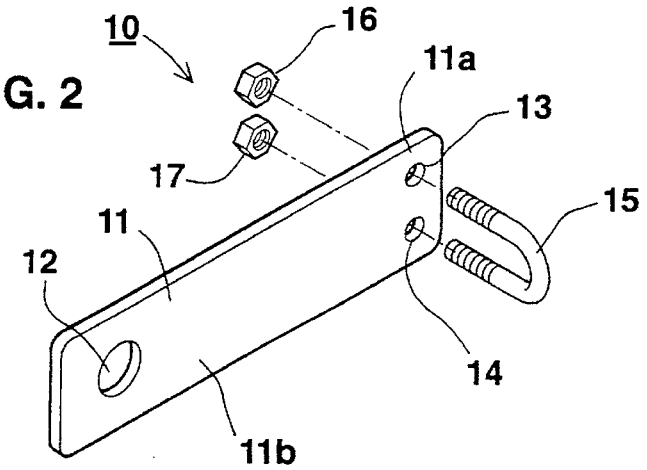
FIGS. 2, 3 and 4 are perspective views illustrating three different types of fastening brackets which may be used for mounting the grille panel.

FIG. 2 illustrates one form of fastening bracket that may be used for the fastening brackets schematically indicated at 9 in FIG. 1. The fastening bracket illustrated in FIG. 2, therein generally designated 10, includes a planar strip 11 of strong material, such as a metal or a strong plastic, formed with a hole 12 at one end, and with a pair of holes 13, 14 at the opposite end. The latter holes are adapted to receive a U-shaped bolt 15 having a pair of legs pass through holes 13, 14, and secured thereto by a pair of nuts 16, 17.

Figure 5:
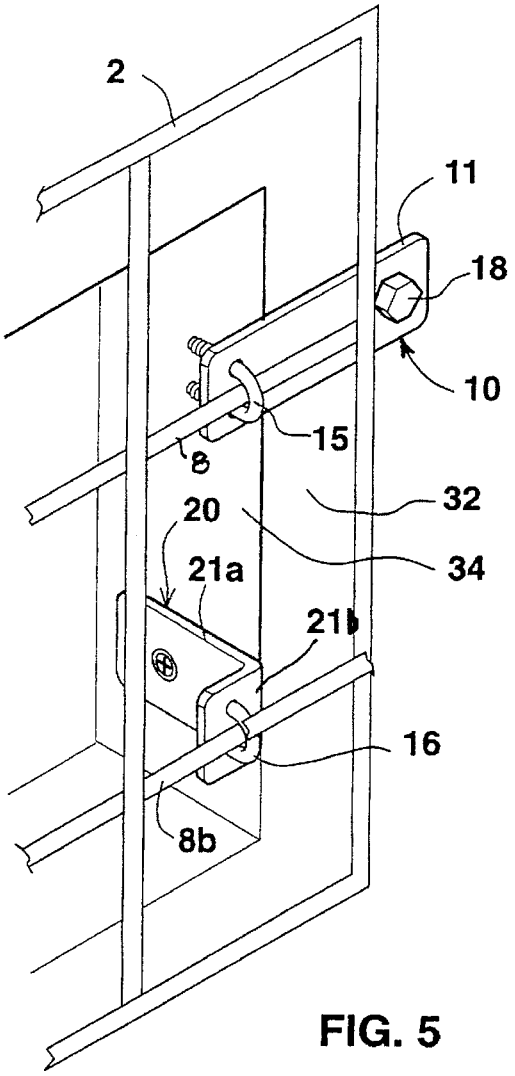
FIGS. 5, 6, 7 and 8 are partial perspective views illustrating various ways of mounting a grille panel in accordance with the present invention.

FIG. 5 illustrates how the bracket 10 of FIG. 2 may be used for mounting the grille panel 2 over the window opening 4. Thus, the bracket strip 11 is placed on the inner side of an end of one of the bars 8 in the grille panel 2, and the U-bolt 15 is then passed through the holes 13, 14 of strip 11 to loosely enclose the end of the bar. The strip 11 is then slid along the bar outwardly until the end of the strip formed with the hole 12 overlies a suitable mounting surface of the wall W, whereupon bolt 15 is passed through hole 12 to attach the strip to the wall. The two nuts 16, 17 may then be tightened to cause the U-bolt 15 to firmly grip the end of the grille bar 8.

It will thus be seen that the U-bolt 15 attached to one end of strip 11 serves as a loop section for slidably enclosing an end of the grille bar 8, and the opposite end of strip 11 formed with hole 12 serves as a fastening section for fastening the bracket to the wall after the loop section has been slid along the bar to a location where the fastening section can be fastened to a mounting surface of the wall. Normally, the loop sections of a plurality of the brackets would first be applied to their respective bars, and then they would be moved outwardly of their respective bars to a location where their respective fastening sections can be fastened to a mounting surface of the wall.

For purposes of illustration, FIG. 5 also illustrates a second form of bracket, generally designated 20, also used for mounting the grille panel 2 over the window opening 4. Bracket 20 shown in FIG. 5 is more particularly illustrated in FIG. 3. It also includes a strip 21 formed at one end with a hole 22, and at the opposite end with a pair of holes 23, 24 for receiving a U-bolt 25 adapted to be fixed by a pair of nuts 26. In this case, however, strip 21 is formed with a right-angle bend 29, such that section 21*a* of the strip formed with hole 22, and serving as the attaching section of the bracket, is perpendicular to section 21*b* of the strip carrying the U-bolt 25 and serving as the loop section of the bracket.

As shown in FIG. 5, bracket 20 is applied in substantially the same manner as described above with respect to bracket 10, except that after the loop section of the bracket has been applied to the respective grille bar 8, the bracket is moved until the attaching section 21*a* engages surface W of the wall, which is perpendicular to the plane of the window opening, at which time fastener 28 is passed through hole 22 in the attaching section of the bracket to attach it to the wall.

Figure 4:
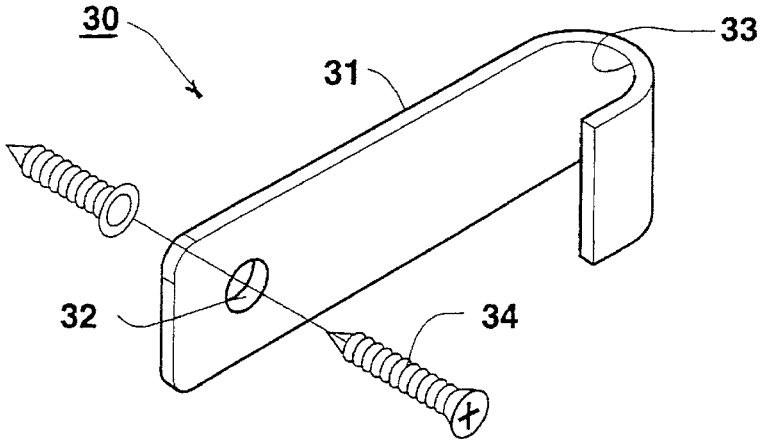

FIG. 4 illustrates another bracket 30 that may be used. This bracket is also constructed of a strip 31 formed with a hole 32 at one end, serving as the attaching section of the bracket. In the construction of FIG. 4, however, the loop section of the bracket is a semi-circular loop 33 formed at the opposite end of strip 31 for enclosing the respective bar of the grille panel to be mounted over the window opening. As shown in FIG. 4, the loop section 33 defines a loop of about 180°, such that it may be applied to enclose (partially) the respective grille bar and then slid along the bar until the bracket is fastened to the wall by bolt 34 passing through hole 32 in the attaching section of the bracket.

Figure 3:
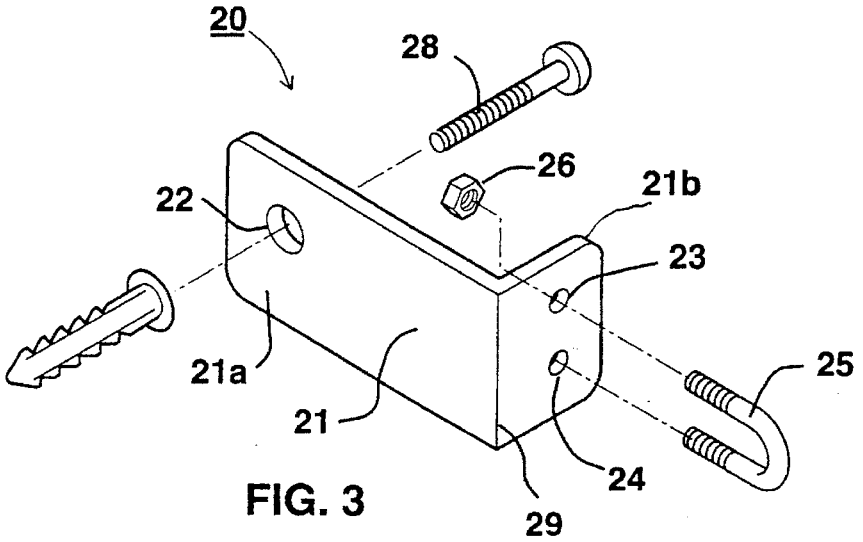

The bracket construction illustrated in FIGS. 2–4, and the method of using them for mounting the grille panel illustrated in FIG. 5, are particularly useful for mounting the grille panel substantially flush with the window opening, i.e. with the inner face of the grille panel substantially flush with the outer face of the window opening.

Figure 6:
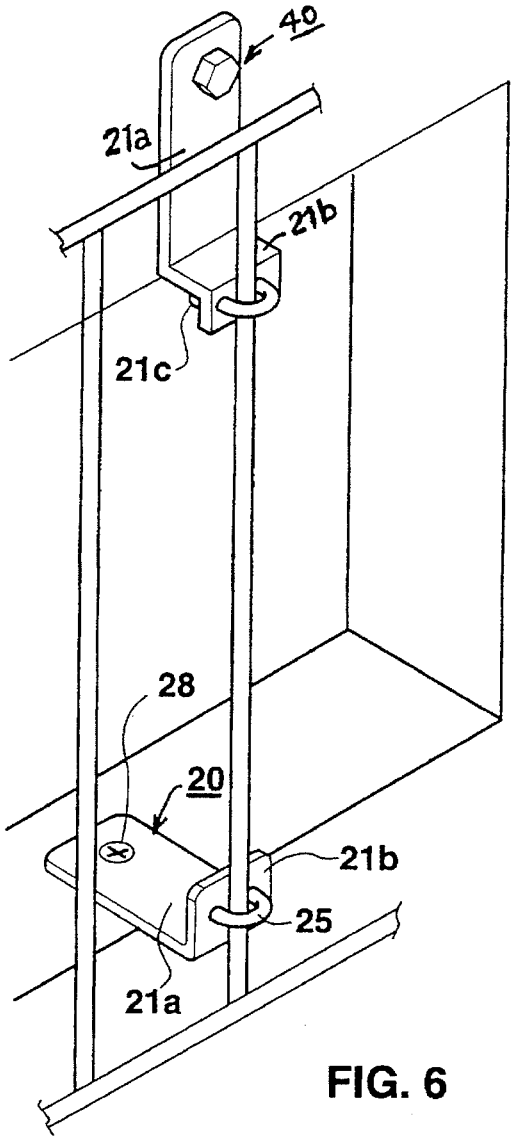

FIG. 6 illustrates modifications that may be made in the construction of the brackets in order to mount the grille panel to project outwardly of the wall formed with the window opening. Thus, as shown in FIG. 6, the bracket construction 20 shown in FIG. 3 may be used for this purpose, in which case the fastening section 21*a* of the bracket would be fastened by bolt 28 to the wall mounting surface at a location such that the loop section 21*b* of the bracket, receiving the respective grille bar 6 via the U-bolt 25, would be spaced outwardly from the window opening.

FIG. 6 also illustrates another bracket construction, generally designated 40, which also may be used for mounting the grille panel to project outwardly of the window opening. Bracket 40 is of substantially the same construction as bracket 20, also including a fastening section 21*a* and a loop section 21*b*, except in this case the two sections are joined together via an intermediate section 21*c* perpendicular to the two sections. Thus, bracket 40 illustrated in FIG. 6 may be mounted in the same manner as described above with respect to bracket 10 illustrated in FIGS. 2 and 5 to an outer mounting surface of the wall W, except that the use of this bracket would mount the grille panel to project outwardly of the window opening.

Figure 7:
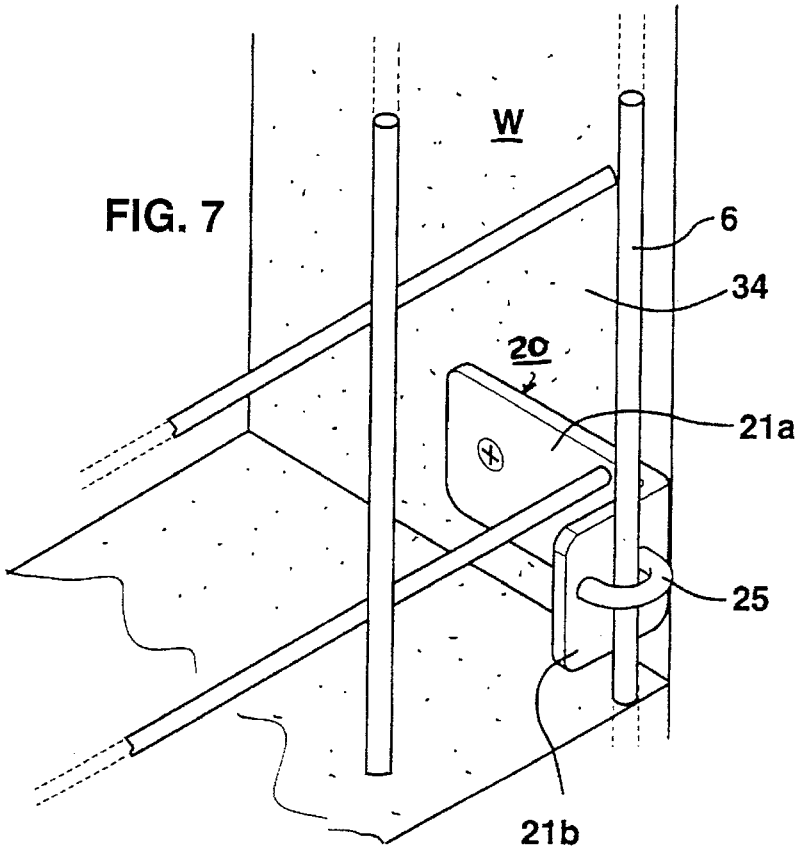
Figure 8:
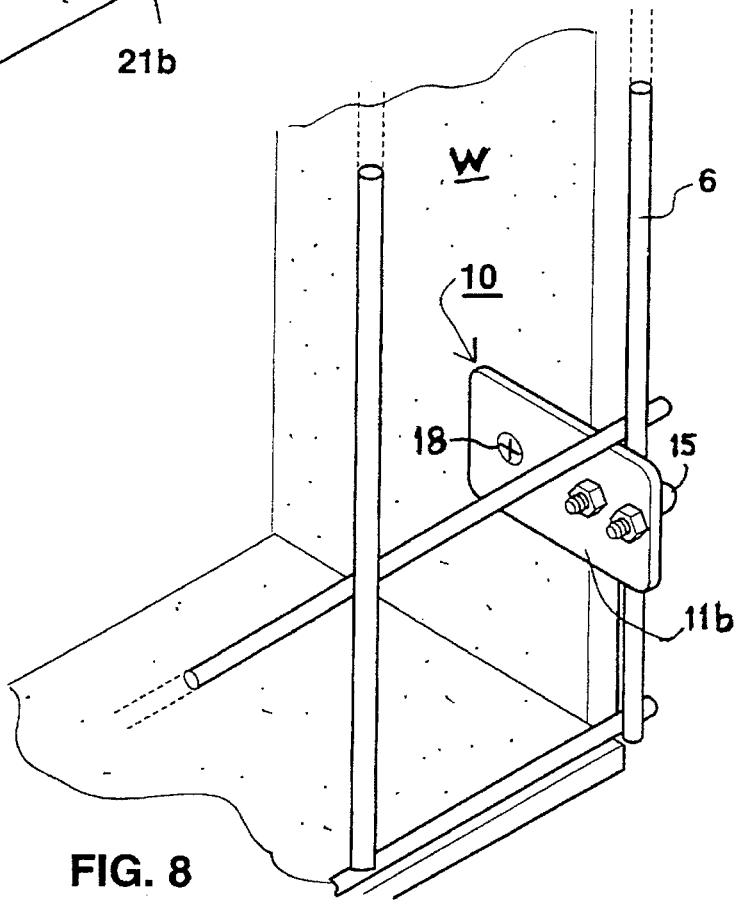

FIGS. 7 and 8 illustrate how the brackets of FIGS. 3 and 2, respectively, can be used for also hingedly mounting the grille panel 2 to enable the grille panel to pivot about a vertical axis. For this purpose, the loop section of each bracket is engageable with an outer vertical bar of the grille panel. Thus, in the right-angle bracket 20 illustrated in FIG. 7 (having the bracket construction of FIG. 3), the U-bolt 25 in the loop section 21*b* of the bracket slidably encloses the end vertical bar 6 of the grille panel 2, while the fastening section 21*a* of the bracket is fixed to the inner wall surface W. In FIG. 8 illustrating the straight bracket 10 shown in FIG. 2, the U-bolt 15 in the loop section of the bracket slidably encloses the end vertical bar 6 of the grille panel, while the fastening section 11*b* of the bracket is secured by bolt 18 to the wall mounting surface W.

Figure 9:
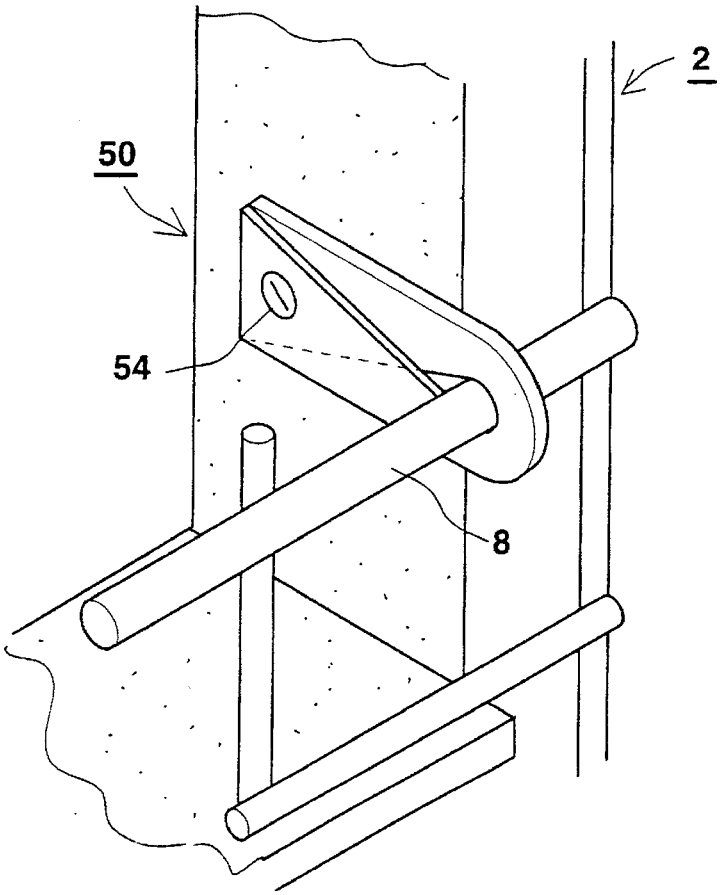
FIG. 9 illustrates another form of fastening bracket which may be included in the protective grille assembly in accordance with the present invention, FIGS. 9*a* and 9*b* illustrating the closed and open positions of the bracket of FIG. 9.
Figure 9A:
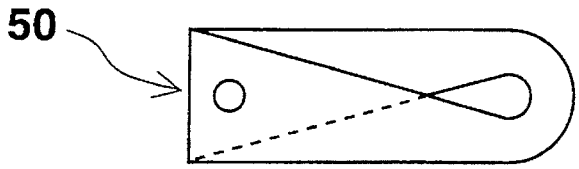
Figure 9B:
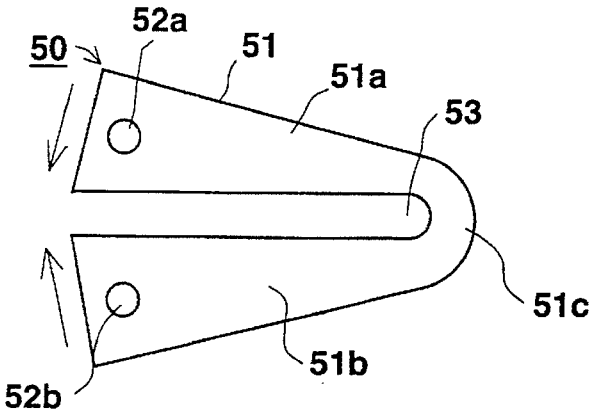

FIG. 9 illustrates a further form of fastening bracket that may be used. The fastening bracket of FIG. 9, therein generally designated 50, is constituted of a unitary plastic strip 51 in which its opposed ends 51*a*, 51*b* are each formed with a hole 52*a*, 52*b* and are Joined together at an intermediate portion by an integral hinge 51*c*, permitting the two apertured ends to be pivoted either to a closed position illustrated in FIG. 9*a*, or to an open position illustrated in FIG. 9*b*. In the closed position, the two ends 51*a*,51*b* are aligned with each other and serve as the fastening section of the bracket, whereas the integral hinge 51*c* serves as the loop section of the bracket for slidably engaging the bar 8 of the grille panel 2. Thus, the bracket illustrated in FIG. 9 is first placed in its open position (FIG. 9*b*), is then applied around the grille bar 8 so that the bar is received within the loop portion 53, is pivoted to its closed position (FIG. 9*a*), and is then slid along the grille bar until its aligned apertured ends 52*a*, 52*b* contact the wall mounting surface W, whereupon a bolt 54 is passed through the aligned apertures 52*a*, 52*b* to fix the bracket to the wall mounting surface.

Figure 10:
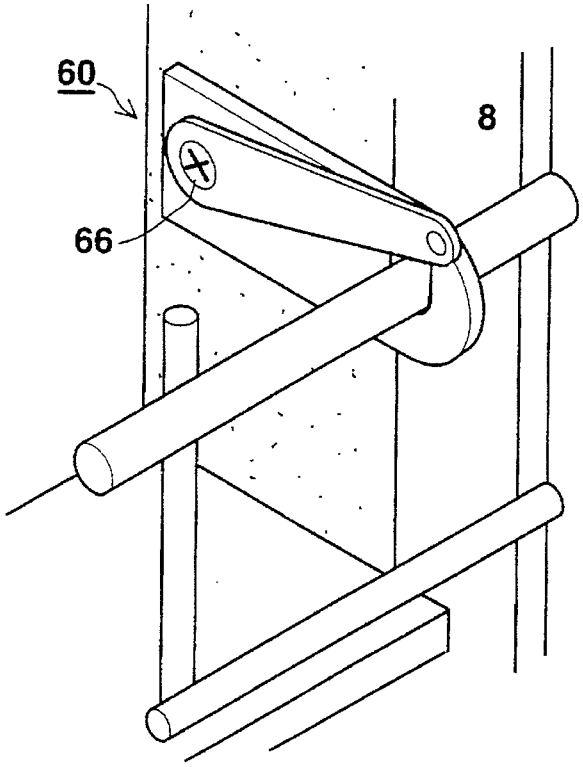
FIG. 10 illustrates another construction of a fastening bracket which may be used in the protective grille assembly of the present invention, FIGS. 10*a* and 10*b* illustrating the closed and open positions of the bracket of FIG. 10.
Figure 10A:
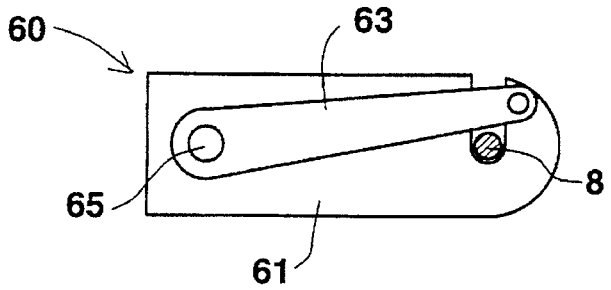
Figure 10B:
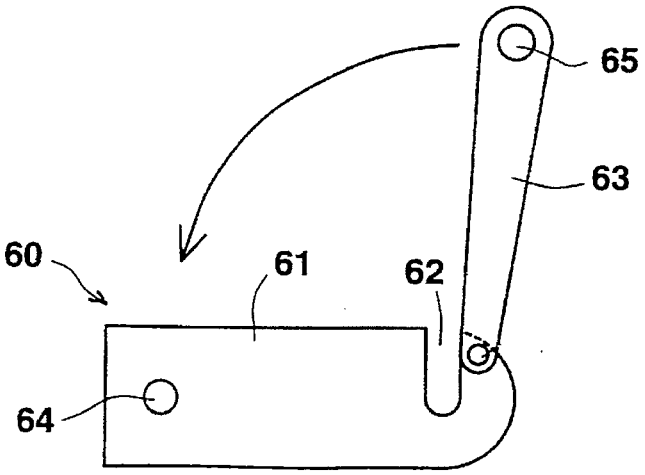

FIG. 10 illustrates another fastening bracket, generally designated 60, that may be used. This bracket includes a first strip 61 formed at one end with a transverse slot 62 open at one edge of the strip and terminating short of the opposite edge. The bracket includes a second strip 63 pivotally mounted at one end 64 to strip 61 to either an open position (FIG. 10*b*) away from the open end of slot 62, or to a closed position (FIG. 10*a*) closing the open end of slot 62. Both strips 61, 63 are formed at their ends, opposite to that of slot 62, with fastening holes 64, 65, respectively, which come into alignment with each other in the closed position of the bracket (FIG. 10*a*), for receiving a bolt 66 fastening the bracket to the wall W.

Thus, in using bracket 60 illustrated in FIG. 10, strip 63 is first pivoted to its open position (FIG. 10*b*) and is applied to the grille bar 8 by seating the grille bar within slot 62. Then strip 63 is pivoted to its closed position (FIG. 10*a*) to enclose the grille bar, permitting the bracket to be slid along the grille bar until the attaching section, constituted by the ends of the two strips formed with openings 64, 65, contact the mounting wall surface W. Finally the bracket is fixed to the wall by passing bolt 66 through the aligned holes 64, 65.

Figure 11:
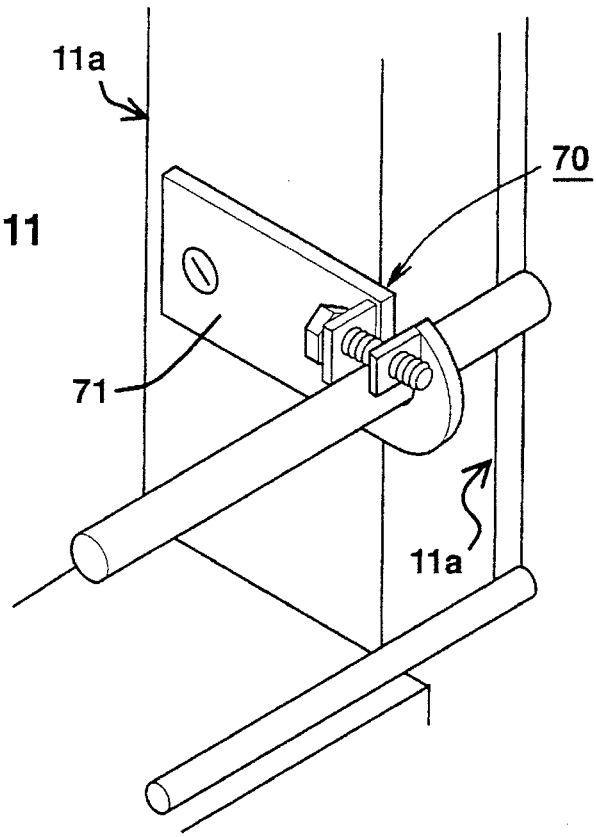
FIG. 11 illustrates a still further form of fastening bracket that may be used, FIG. 11*a* being a sectional view along line 11*a*—11*a* of FIG. 11.
Figure 11A:
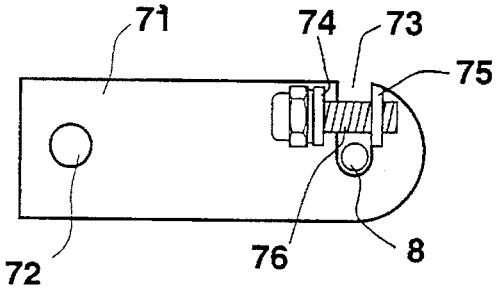

FIG. 11 illustrates a further construction of a bracket, generally designated 70, which may be used in the protective grille assembly. This bracket includes a strip 71 formed with a hole 72 at one end, constituting the fastening section of the bracket, and with a transverse slot 73 at the opposite end, serving as the loop section of the bracket. The latter end of strip 71 is formed with a pair of projecting lugs 74, 75 on opposite sides of slot 73, and a pin 76 is threaded through these lugs for closing the slot after the grille bar 8 has been inserted into the slot, as shown particularly in FIG. 11*a*. A plurality of brackets such as illustrated in FIG. 11 may thus be used for fixing the grille panel 2 to the wall W formed with the window opening to cover the window opening in the manner described above.

Figure 12:
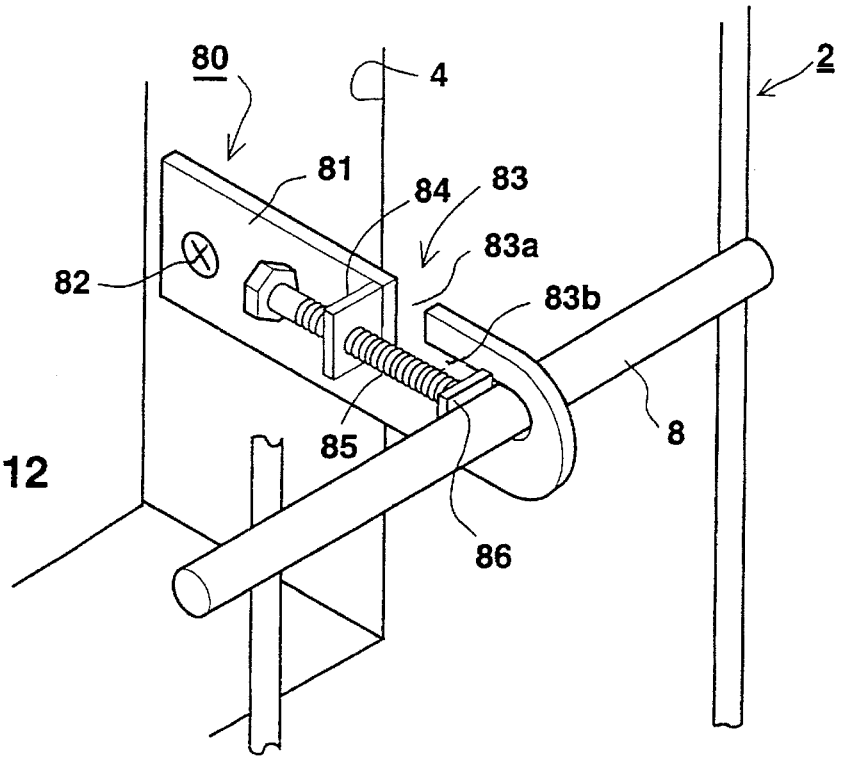
FIG. 12 is a perspective view illustrating a still further form of fastening bracket that may be used particularly where the grille panel is to be mounted to project outwardly of the window opening.

FIG. 12 illustrates an attaching bracket particularly useful for mounting the grille panel 2 to project outwardly of the window opening 4. The bracket illustrated in FIG. 12, therein generally designated 80, includes a strip 81 formed with a hole at one end adapted to receive the fastening bolt 82 constituting the fastening section of the bracket, and with a slot formation 83 at the opposite end. Slot formation 83 includes a transverse slot 83*a* extending from an edge of the strip, and an axial slot 83*b* communicating at one end (the end facing the fastening bolt 82), with the transverse slot and extending axially of the slot towards the opposite end. Strip 81 is further formed with a right angle lug 84 between the fastening section and the transverse slot 83*a*, and a threaded pin 85 is threaded through lug 84 and carries a pressure member 86 at its outer tip bearing against the grille bar 8 of the grille panel 2.

When fastening bracket 80 is to be applied to the grille bar 8, pin 85 is threaded to its fully open position, allowing the grille bar to pass through slot 83*a* into slot 83*b*. Pin 85 is then threaded slightly inwardly to move the grille bar further into slot 83*b* but to permit the bracket to freely slide along the grille bar 8 until the fastening section 81 of the bracket engages the wall mounting surface, whereupon the bracket is fixed to the wall mounting surface by bolt 82. Pin 85 may then be tightened to lock bar 8 within slot 83*b*.

While the invention has been described with respect to several preferred embodiments, it will be appreciated that these are set forth merely for purposes of example, and that many other variations, modifications and applications of the invention may be made.

I claim:

1. A protective grille assembly mountable over a window opening in a wall, comprising:

a grille panel having a plurality of parallel, spaced, vertical bars fixed to a plurality of parallel, spaced, horizontal bars, the grille panel being of larger dimension than said window opening such that the ends of the bars along at least one side project past the respective side of the window opening when the grille panel is mounted thereto;

and a plurality of fastening brackets for mounting said grille panel to said wall to cover said opening;

each of said brackets including a loop section for slidably enclosing an end of a bar at the projecting side of the grille panel, and a fastening section for fastening the bracket to said wall after the loop section, while enclosing an end of a bar, has been slid along the respective bar to a location where the fastening section can be fastened to a mounting surface of the wall;

wherein said mounting surface of the wall for mounting at least one of said brackets borders said window opening and is perpendicular to the plane of said window opening, and wherein said loop section is perpendicular to said fastening section of said at least one bracket and is defined by a U-bolt having its two opposite ends received within two openings in the bracket and secured thereto by nuts.

2. The protective grille assembly according to claim 1, wherein the loop sections of said plurality of brackets are applied to vertical bars and to horizontal bars of the grille to fix the grille over the window opening.

3. The protective grille assembly according to claim 1, wherein there are at least a pair of said brackets including loop sections engaging the opposite ends of a vertical bar at one side of the grille panel, thereby permitting the grille panel also to be pivoted about the axis of said end vertical bar.

4. A method of mounting a protective grille assembly over a window opening in a wall, wherein said mounting surface of the wall for mounting at least one of said brackets borders said window opening and is perpendicular to the plane of said window opening, said method comprising:

providing a grille panel having a plurality of parallel, spaced, horizontal bars, the grille panel being of larger dimension than said window opening, such that the ends of the bars along at least one side project past the respective side of the window opening;

providing a plurality of fastening brackets for mounting said grille assembly to said wall to cover said opening, each of said brakcets including a loop section for slidably enclosing an end of a bar at the projecting side of the grille panel, and a fastening section for fastening the bracket to the wall, and wherein said loop section is perpendicular to said fastening section of said at least one bracket and is defined by a U-bolt having its two opposite ends received within two openings in the bracket and secured to by nuts;

applying the loop section of a plurality of said brackets to a plurality of bars at the projecting side of the grille panel;

sliding said so-applied brackets along their respective bars until the fastening sections of the respective brackets contact a mounting surface of the wall;

and fixing said fastening sections of the brackets to said mounting surface of the wall.

5. The method according to claim 4, wherein the loop sections of said plurality of fastening brackets are applied to vertical bars and to horizontal bars of the grille to fix the grille over the window opening.

6. The method according to claim 5, wherein there are at least a pair of said brackets including loop sections engaging the opposite ends of a vertical bar at one side of the grille panel, thereby permitting the grille panel also to be pivoted about the axis of said end vertical bar.

* * * * *